US007232164B2

(12) United States Patent
Lee

(10) Patent No.: US 7,232,164 B2
(45) Date of Patent: Jun. 19, 2007

(54) SAFETY APPARATUS FOR VEHICLE DOOR HANDLE ASSEMBLIES

(75) Inventor: Jong-Ho Lee, Hwaseong-si (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 0 days.

(21) Appl. No.: 11/304,942

(22) Filed: Dec. 14, 2005

(65) Prior Publication Data

US 2007/0080547 A1 Apr. 12, 2007

(30) Foreign Application Priority Data

Oct. 7, 2005 (KR) ..... 10-2005-0094270

(51) Int. Cl.
*E05B 3/00* (2006.01)

(52) U.S. Cl. ..... 292/336.3; 292/DIG. 22; 292/DIG. 65

(58) Field of Classification Search ..... 292/336.3, 292/DIG. 22, DIG. 65
See application file for complete search history.

(56) References Cited

U.S. PATENT DOCUMENTS 6,554,331 B2 * 4/2003 Ciborowski et al. ..... 292/347
7,070,216 B2 * 7/2006 von zur Muehlen ..... 292/336.3
7,111,880 B2 * 9/2006 Saitoh ..... 292/336.3
2005/0206176 A1 * 9/2005 Ooe et al. ..... 292/336.3

FOREIGN PATENT DOCUMENTS

| | | |
|---|---|---|
| JP | 9144394 | 6/1997 |
| JP | 10169259 | 6/1998 |
| JP | 2000008664 | 1/2000 |
| JP | 2000054692 | 2/2000 |
| JP | 2000145211 | 5/2000 |
| JP | 2001132282 | 5/2001 |

* cited by examiner

*Primary Examiner*—Gary Estremsky
(74) *Attorney, Agent, or Firm*—Morgan Lewis & Bockius LLP

(57) ABSTRACT

A safety apparatus for vehicle door handle assemblies. The safety apparatus of the present invention prevents a door from being opened by undesirable operation of a door handle assembly by inertial force when outside impact is applied to a vehicle body, thus enhancing the stability of the vehicle.

3 Claims, 5 Drawing Sheets

SAFETY APPARATUS FOR VEHICLE DOOR HANDLE ASSEMBLIES

CROSS-REFERENCE TO RELATED APPLICATIONS

The present application is based on, and claims priority from, Korean Application Serial Number 10-2005-0094270, filed on Oct. 7, 2005, the disclosure of which is hereby incorporated by reference herein in its entirety.

FIELD OF THE INVENTION

The present invention relates to safety apparatuses for vehicle door assemblies and, more particularly, to a technique which prevents a door handle from being undesirably operated by impact applied to a vehicle door.

BACKGROUND OF THE INVENTION

As well known to those skilled in the art, a door handle of a vehicle has a mechanism for releasing a door latch by rotation of the door handle with respect to a door when a user pulls the door handle with his/her hand.

Furthermore, because the door handle has a predetermined weight in itself, if strong outside impact is applied to the door, the door handle may be rotated by inertial force without manipulation of the user. Then, the door latch may be released by the rotation of the door handle. Thereby, the door may undesirably open, thus resulting in a dangerous condition.

Therefore, a separate apparatus for door handle assemblies has been required to prevent a door handle from undesirably rotating due to inertial force.

SUMMARY OF THE INVENTION

Embodiments of the present invention provide a safety apparatus for vehicle door handle assemblies which prevents a door from being opened due to undesirable operation of a door handle assembly by inertial force when outside impact is applied to a vehicle body, thus enhancing the stability of the vehicle.

A safety apparatus for vehicle door handle assemblies according to an embodiment of the present invention includes a connection lever in contact with a structure of a door handle that is disposed inside a door, such that, when the door handle is pulled outwards from the door, the connection lever is rotated. An operating lever is coupled to the connection lever and transmitting rotation of the connection lever to a latch cable. A balance weight is placed at a position opposite a junction between the connection lever and the door handle based on a rotating shaft of the connection lever. A coupling means couples the balance weight and the connection lever to each other, such that, when the inertial force of the balance weight is biased outside the door, the balance weight and the connection lever are rotated in a same direction, and when the inertial force of the balance weight is biased inside the door, the balance weight and the connection lever are rotated in opposite directions.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
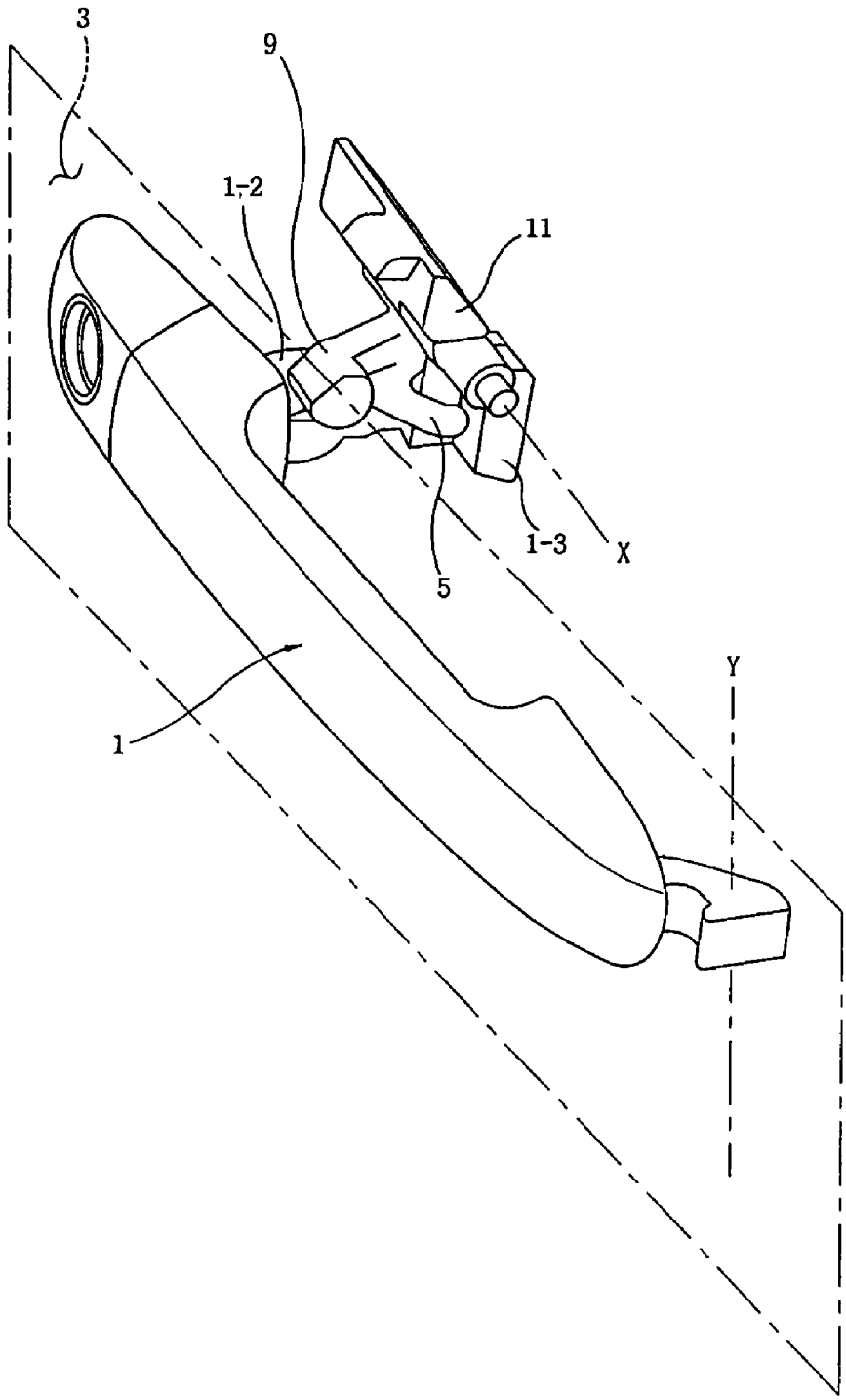
FIGS. 1 and 2 are views showing a safety apparatus for vehicle door handle assemblies, according to a preferred embodiment of the present invention.

Hereinafter, a preferred embodiment of the present invention will be described in detail with reference to the attached drawings.

Referring to FIGS. 1 through 4, a safety apparatus for vehicle door handle assemblies according to the preferred embodiment of the present invention includes a connection lever 5 which is in contact with a structure of a door handle 1 that is disposed inside a door 3, such that, when the door handle 1 is pulled outwards from the door 3, the connection lever 5 is rotated. The safety apparatus further includes an operating lever 9 which is integrally coupled to the connection lever 5 and transmits rotation of the connection lever 5 to a latch cable 7, and a balance weight 11 which is placed at a position opposite the junction between the connection lever 5 and the door handle 1 based on a rotating shaft (X) of the connection lever 5. The safety apparatus further includes a coupling means which couples the balance weight 11 and the connection lever 5 to each other, such that, when the inertial force of the balance weight 11 is biased towards the outside of the door 3, the balance weight 11 and the connection lever 5 are rotated in the same direction, and when the inertial force of the balance weight 11 is biased towards the inside of the door 3, the balance weight 11 and the connection lever 5 are rotated in opposite directions.

Figure 2:
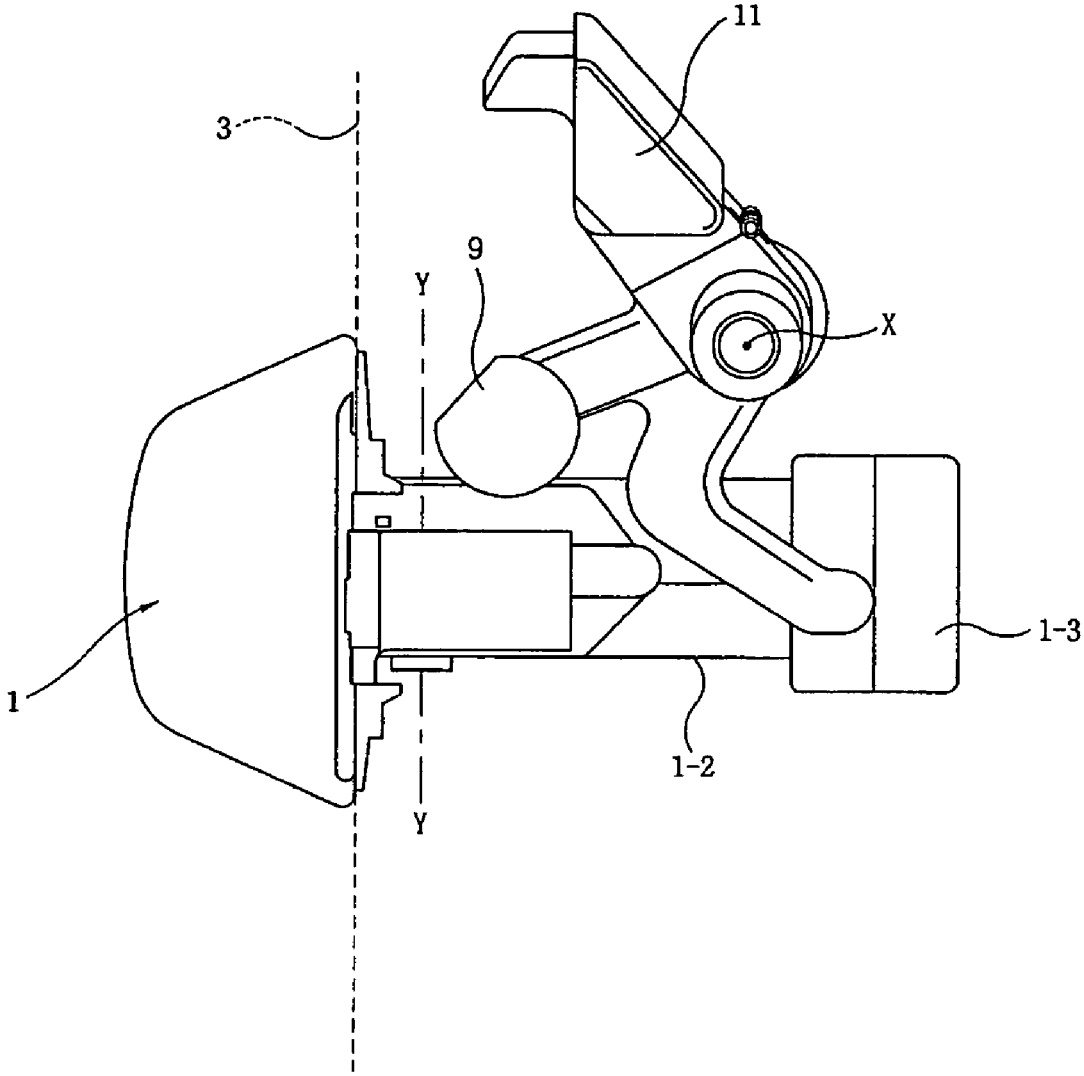

For reference, the left side in FIG. 2 indicates the outside of the door 3.

The door handle 1 has a handle extension part 1–2 which extends inside the door 3 from the door handle 1, and a lever contact part 1–3 which is integrated with the handle extension part 1–2 and is in close contact with the connection lever 5.

The internally disposed structure of the door handle 1 means the handle extension part 1–2 and the lever contact part 1–3.

The door handle 1 is coupled to the door 3 and is rotatable around a handle hinge shaft (Y). Thus, when a user pulls the door handle 1, the handle extension part 1–2 and the lever contact part 1–3 are rotated around the handle hinge shaft (Y), which serves as a rotating shaft.

The connection lever 5 is supported by a separate spring, which is not shown in the drawings, such that an end of the connection lever 5 maintains a state of being in close contact with the lever contact part 1–3.

The coupling means includes an active lever surface 13 which is formed on an upper end of the connection lever 5, and an active weight surface 15 which is formed under a lower end of the balance weight 11 so that the active weight surface 15 is in surface contact with the active lever surface 13. The coupling means further includes a hinge shaft 17 which is provided on ends of both the active lever surface 13 and the active weight surface 15 that are close to an inner sidewall of the door 3. The hinge shaft 17 is parallel with the rotating shaft (X) of the connection lever 5 and couples the active lever surface 13 and the active weight surface 15 to each other such that the active lever surface 13 and the active weight surface 15 are rotatable with respect to each other around the hinge shaft 17.

Furthermore, a torsion spring 19 is provided on the hinge shaft 17 so as to elastically support a state in which the active weight surface 15 is in surface contact with the active lever surface 13.

When the user pulls the door handle 1 outwards from the door 3, the lever contact part 1–3 of the door handle 1 is moved in an outside direction of the door 3, thus rotating the connection lever 5. Then, the operating lever 9, which is integrally coupled to the connection lever 5, pulls the latch cable 7, thus releasing a door latch, which is not shown in the drawings.

If impact is applied from the outside to a side surface of the door 3, the door handle 1 and the balance weight 11 have inertial force in the same direction.

In detail, in a normal state in which the door handle 1 is not pulled, if inertial force, intended to move the door handle 1 and balance weight 11 outwards with respect to the door 3, is applied to the door handle 1 and the balance weight 11 due to impact applied from the outside to the door 3, the lever contact part 1–3 of the door handle 1 is biased in the outside direction of the door 3.

Simultaneously, rotating force, intended to rotate the balance weight 11 in a counter clockwise direction around the rotating shaft (X) of the connection lever 5 due to the inertial force intended to move outwards with respect to the door 3, is applied to the balance weight 11. This rotating force is transmitted to the connection lever 5, thus pushing the connection lever 5 such that the connection lever 5 is rotated in a counter clockwise direction.

The force, intended to rotate the connection lever 5 in a counter clockwise direction, is offset by the force, intended to move the lever contact part 1–3 of the door handle 1 in the outside direction of the door 3. Therefore, the connection lever 5 is prevented from rotating in a clockwise direction due to the force transmitted to the lever contact part 1–3 of the door handle 1.

Thus, the operating lever 9 integrated with the connection lever 5 is not rotated, so that the latch cable 7 is not pulled. As a result, the door 3 is prevented from being opened.

Furthermore, in a normal state in which the door handle 1 is not pulled, when impact is applied from the outside to the door 3, even if inertial force, intended to move the door handle 1 and balance weight 11 inwards with respect to the door 3, is applied to the door handle 1 and the balance weight 11, the door 3 prevents the door handle 1 itself from moving into the door 3.

Figure 5:
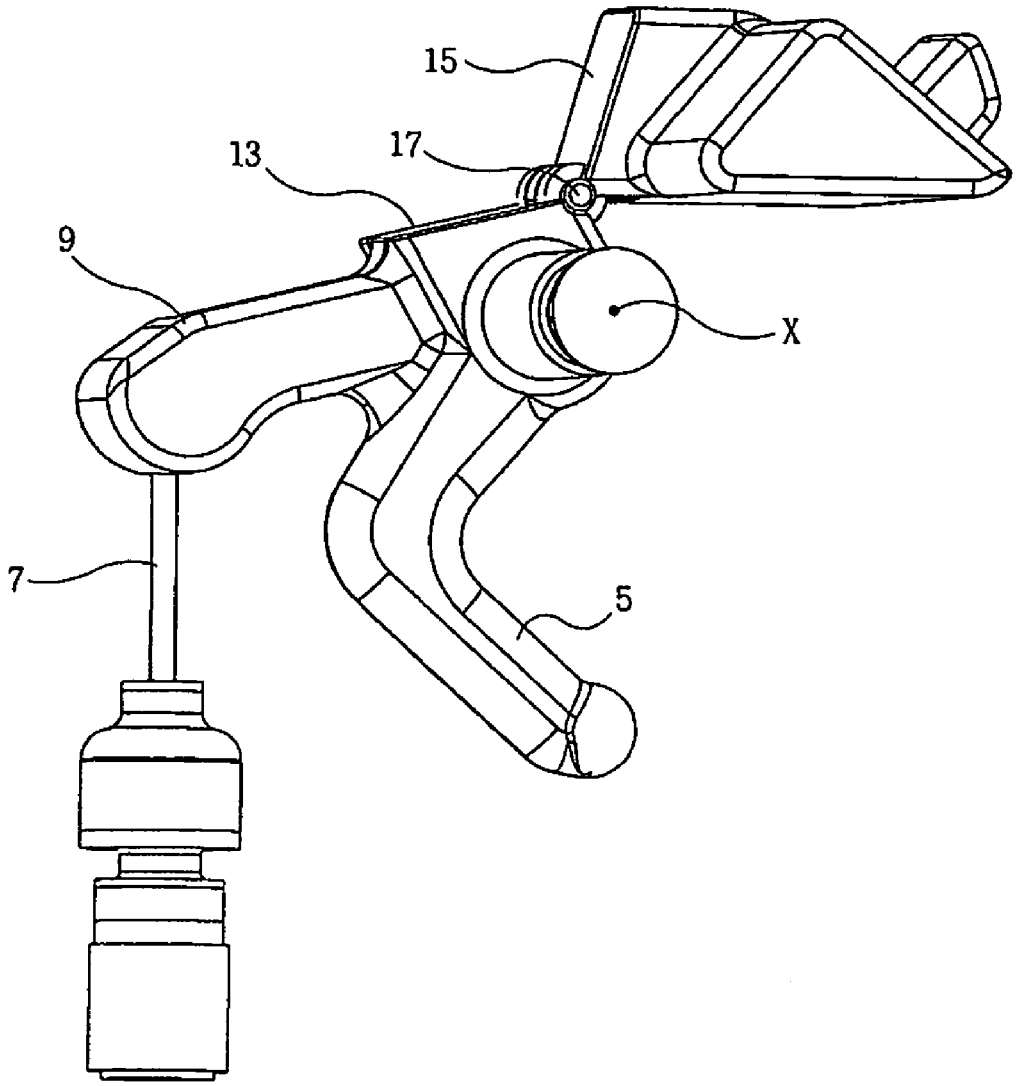
FIG. 5 is a perspective view showing operation of the balance weight of the safety apparatus of the present invention, for comparison with FIG. 3.

At this time, as shown in FIG. 5, the balance weight 11 is rotated around the hinge shaft 17 by the inertial force biased in an inward direction of the door 3, but the connection lever 5 and the operating lever 9 do not rotate.

The reason is that most of the inertial force applied to the balance weight 11 is consumed to rotate the balance weight 11 around the hinge shaft 17, and remaining force is applied to the hinge shaft 17, serving as a point of action, in an inward direction of the door 3, but the force applied to the hinge shaft 17 cannot overcome the elasticity of the spring, which is constructed to contact the connection lever 5 with the lever contact part 1–3, because the distance between the hinge shaft 17 and the rotating shaft of the connection lever 5 is relatively narrow.

Therefore, the operating lever 9 also does not pull the latch cable 7, thus preventing the door 3 from being opened.

Figure 3:
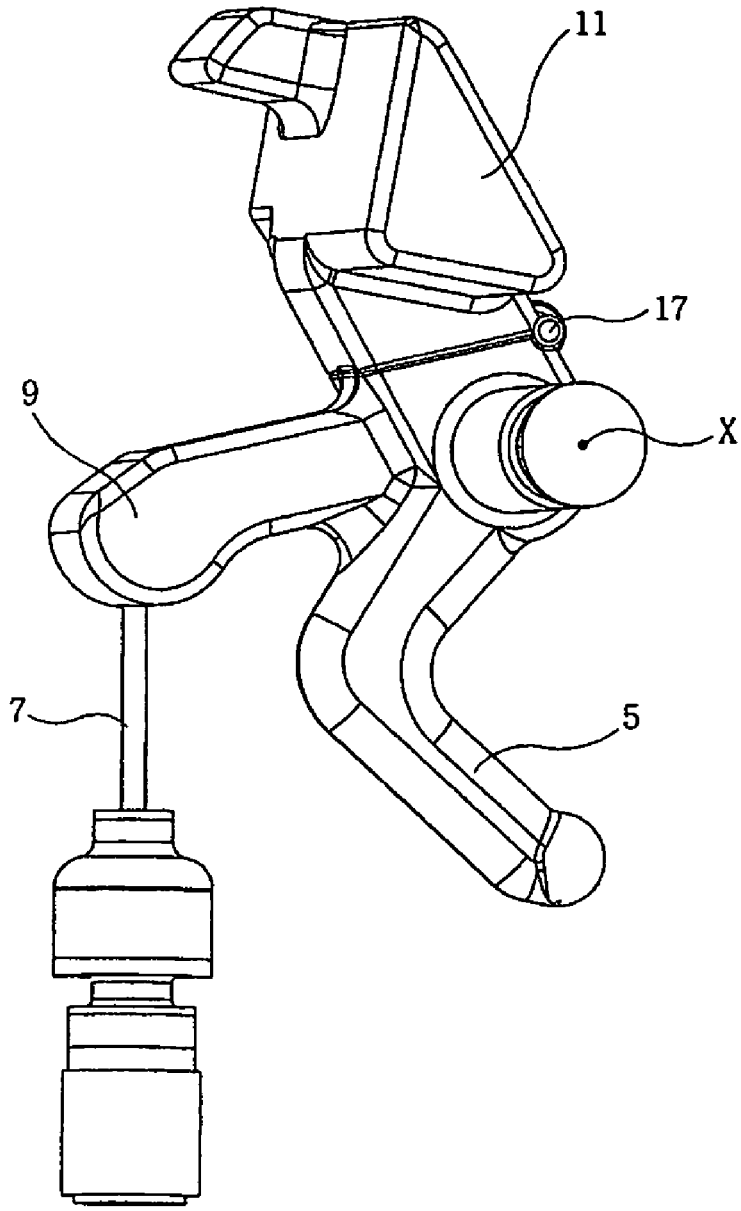
FIGS. 3 and 4 are perspective views showing both a connection lever and a balance weight of the safety apparatus of FIGS. 1 and 2.
Figure 4:
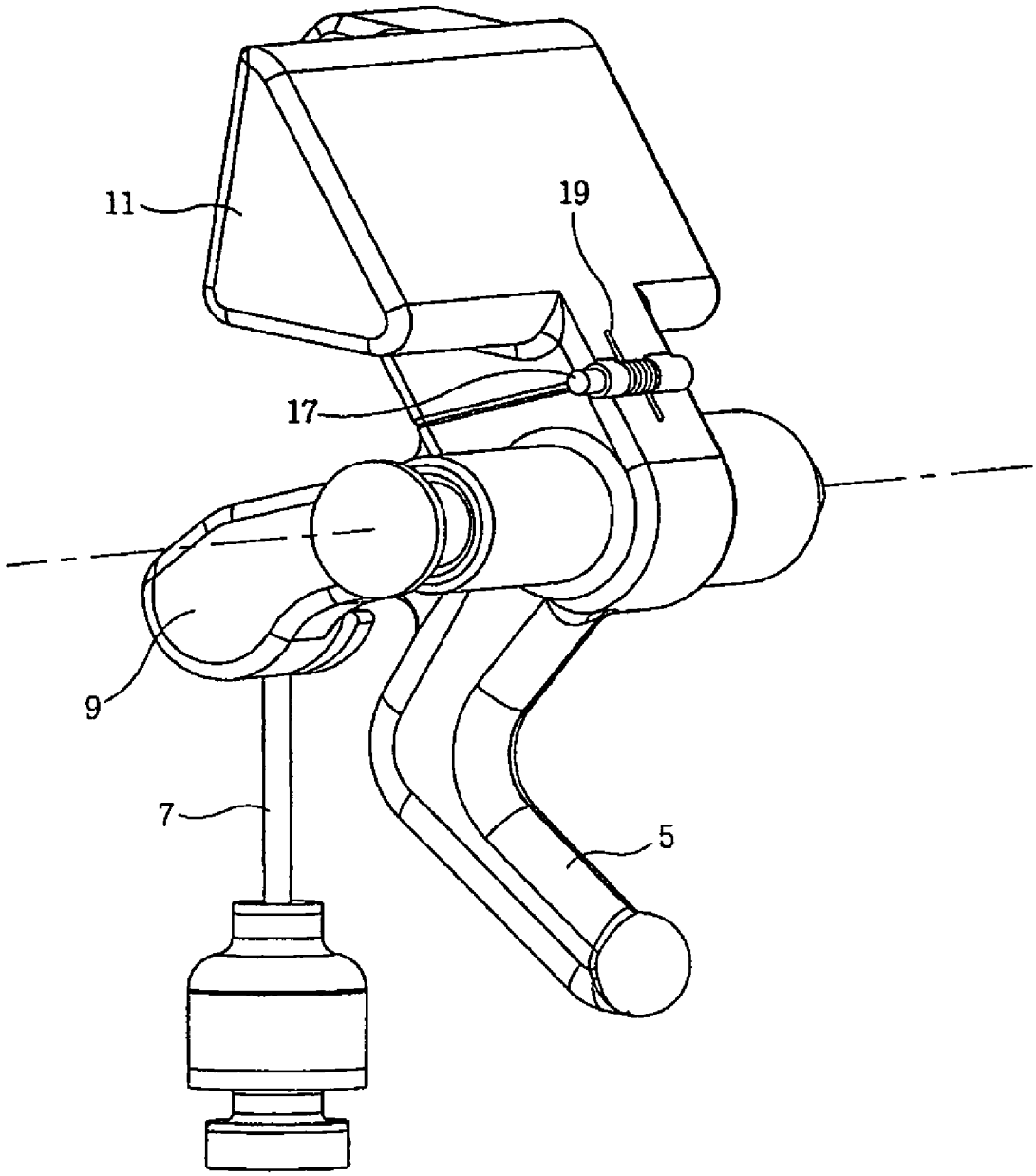

The torsion spring 19, which is provided on the hinge shaft 17, serves to return the balance weight 11, which has rotated around the hinge shaft 17 in an inward direction of the door 3, to the state of FIG. 3.

As is apparent from the foregoing, the present invention provides a safety apparatus for vehicle door handle assemblies which prevents a door from being opened due to undesirable operation of a door handle assembly by inertial force when outside impact is applied to a vehicle body, thus enhancing the stability of the vehicle.

What is claimed is:

1. A safety apparatus for a vehicle door handle assembly, configured for installation in a door comprising an inside surface and an outside surface, the safety apparatus comprising:

a connection lever in contact with a structure of a door handle that is disposed inside the door, such that, when the door handle is pulled outwards from the door, the connection lever is rotated;

an operating lever coupled to the connection lever and transmitting rotation of the connection lever to a latch cable;

a balance weight placed at a position opposite a junction between the connection lever and the door handle based on a rotating shaft of the connection lever; and coupling means coupling the balance weight and the connection lever to each other, such that, when an inertial force of the balance weight is biased toward the outside surface of the door, the balance weight and the connection lever do not rotate, and when the inertial force of the balance weight is biased toward the inside surface of the door, inside the door, the balance weight rotates relative to the connection lever around the rotating shaft.

2. The safety apparatus for the vehicle door handle assembly as defined in claim 1, wherein the coupling means comprises:

an active lever surface formed on an upper end of the connection lever;

an active weight surface formed under a lower end of the balance weight so that the active weight surface is in surface contact with the active lever surface; and a hinge shaft provided on ends of the active lever surface and the active weight surface that are close to an inner sidewall of the door, the hinge shaft being parallel with the rotating shaft of the connection lever and coupling the active lever surface and the active weight surface to each other such that the active lever surface and the active weight surface are rotatable with respect to each other around the hinge shaft.

3. The safety apparatus for the vehicle door handle assembly as defined in claim 2, further comprising:

a torsion spring provided on the hinge shaft so as to elastically support a state in which the active weight surface is in surface contact with the active lever surface.

* * * * *